US006793369B2

(12) United States Patent
Calzaretta et al.

(10) Patent No.: US 6,793,369 B2
(45) Date of Patent: Sep. 21, 2004

(54) LIGHT FIXTURE

(75) Inventors: Gary Calzaretta, Corona, CA (US); Mario Gallo, Wildomar, CA (US)

(73) Assignee: Tivoli LLC, Santa Ana, CA (US)

( * ) Notice: Subject to any disclaimer, the term of this patent is extended or adjusted under 35 U.S.C. 154(b) by 0 days.

(21) Appl. No.: 10/160,581

(22) Filed: May 31, 2002

(65) Prior Publication Data

US 2003/0223233 A1 Dec. 4, 2003

(51) Int. Cl.[7] ..... F21S 4/00

(52) U.S. Cl. ..... 362/219; 362/225; 362/249; 362/365; 362/391; 362/800; 362/226; 439/633; 439/680

(58) Field of Search ..... 362/219, 217, 362/225, 229, 249, 365, 391, 800, 147, 146, 235, 375, 311, 310, 226; 439/680

(56) References Cited

U.S. PATENT DOCUMENTS 5,980,273 A * 11/1999 Yong et al. ..... 439/79
6,116,748 A 9/2000 George
6,145,996 A 11/2000 Shimada
6,283,612 B1 9/2001 Hunter
6,561,689 B1 * 5/2003 Kidd et al. ..... 362/541
6,566,824 B2 5/2003 Panagotacos et al.

FOREIGN PATENT DOCUMENTS

EP 0352430 A2 * 1/1990 ..... F21P/001/00

OTHER PUBLICATIONS

US Pub. No. 2003/0063463 A1, Sloan et al., Apr. 3, 2003. Channel Letter Lighting Using Light Emitting Diodes.*

* cited by examiner

*Primary Examiner*—Stephen Husar
*Assistant Examiner*—Sharon Payne
(74) *Attorney, Agent, or Firm*—Gray Law Firm; Gordon E. Gray, III

(57) ABSTRACT

The present invention generally relates to a lighting fixture where individual light sources can be removed and/or replaced from a strand of light sources. The preferred embodiment of the light fixture comprises a plurality of light sources strung together by a plurality of wire assemblies. Each light source preferably has one end of a tongue and groove connector where the opposing end of the connector is attached to an end of a wire assembly. The strand of light sources is then placed within a lens component, preferably an extrusion. The lens component is connected to a base component; wherein the plurality of light sources are mounted to the base component and contained within the lens component. The fixture can be mounted to, inter alia, a wall, a chair, or a railing in an area to be lit by the fixture.

10 Claims, 2 Drawing Sheets

LIGHT FIXTURE

TECHNICAL FIELD

The present invention generally relates to a lighting system where individuals light sources can be removed and/or replaced from a strand of light sources.

BACKGROUND

Generally, theater and auditorium lighting systems incorporate low voltage lighting strips within extrusions that are then placed on stairs, chairs and walkways in order to illuminate walking areas for patrons and ushers. The prior art has contemplated different ways of arranging the light strips. Typically, the lighting strips are made up of wires soldered to light-emitting diodes ("LEDs") or LED circuit boards. A number of lighting systems are known including U.S. Pat. Nos. 6,283,612, 6,145,996, and 6,116,748.

These systems, however, do not generally provide for the efficient replacement of an LED that has malfunctioned or burned out. It is often cumbersome to replace an LED from a lighting strip and often the entire lighting strip must be replaced and not just the damaged LED. The present invention provides an easier and safer method of replacing one or more LEDs in a lighting strip.

SUMMARY OF THE INVENTION

The present invention generally relates to a lighting fixture where individual light sources can be removed and/or replaced from a strand of light sources. The preferred embodiment of the light fixture comprises a plurality of light sources strung together by a plurality of wire assemblies. Each light source preferably has one end of a tongue and groove connector where the opposing end of the connector is attached to an end of a wire assembly. The strand of light sources is then placed within a lens component, preferably an extrusion. The lens component is connected to a base component; wherein the plurality of light sources are mounted to the base component and contained within the lens component. The fixture can be mounted to, inter alia, a wall, a chair, or a railing in an area to be lit by the fixture.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved light fixture.

Figure 1:
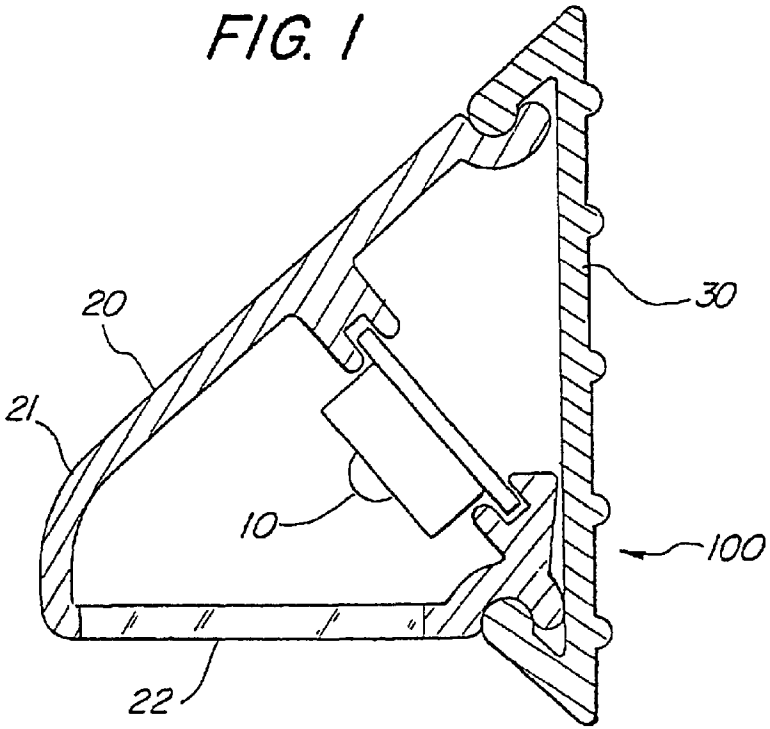
FIG. 1 is a side cross sectional view of a preferred embodiment of the invention.

Referring now to FIG. 1, a side cross sectional view of the preferred embodiment of the improved light fixture 100 is shown. The light fixture 100 of the present invention can be used in, inter alia, theater and auditorium lighting systems to illuminate walkways and corridors for patrons and ushers. Preferably, the fixture 100 comprises two extruded parts, a lens component 20 and a base component 30. Each extrusion is preferably made of polyvinylchloride (PVC) but can also be made of polycarbonate. The lens component 20 can also comprise acrylic.

The lens component 20 preferably comprises two parts, a shield 21 and a lens 22. Preferably, these two parts are co-extruded. The shield 21 is made of an opaque material such that it prevents light from emitting from the light fixture 100 except through the lens 22 that is generally made of a transparent material. As such, the light emitted from the light source 10 through the lens 22 will shine onto the walkways and corridors that need illumination rather than into the eyes of patrons, performers and/or ushers.

The lens component 20 of the fixture 100 also preferably supports a strand of light sources 10. In the preferred embodiment, the light source 10 (an LED on a circuit board is shown in FIG. 1) is mounted to the lens component 20 by sliding the circuit board of the light source 10 into a set of notches on the lens component 20. The light source 10 is therefore held at a set angle to the lens 22 in the lens component 20.

The lens component 20 and the base component 30 preferably connect to one another via a sliding or snap-lock mechanism. As such, the entire fixture 100 can be mounted on a variety of surfaces such as stairs, chairs, walls or walkways via the base component 30 as shown in the preferred use depicted in FIG. 6. When the base component 30 is mounted to a surface, the lens 22 of the lens component 20 is preferably perpendicular to the base component 30 so that the light emitted from the light source 10 shines on to a desired area for illumination.

Figure 6:
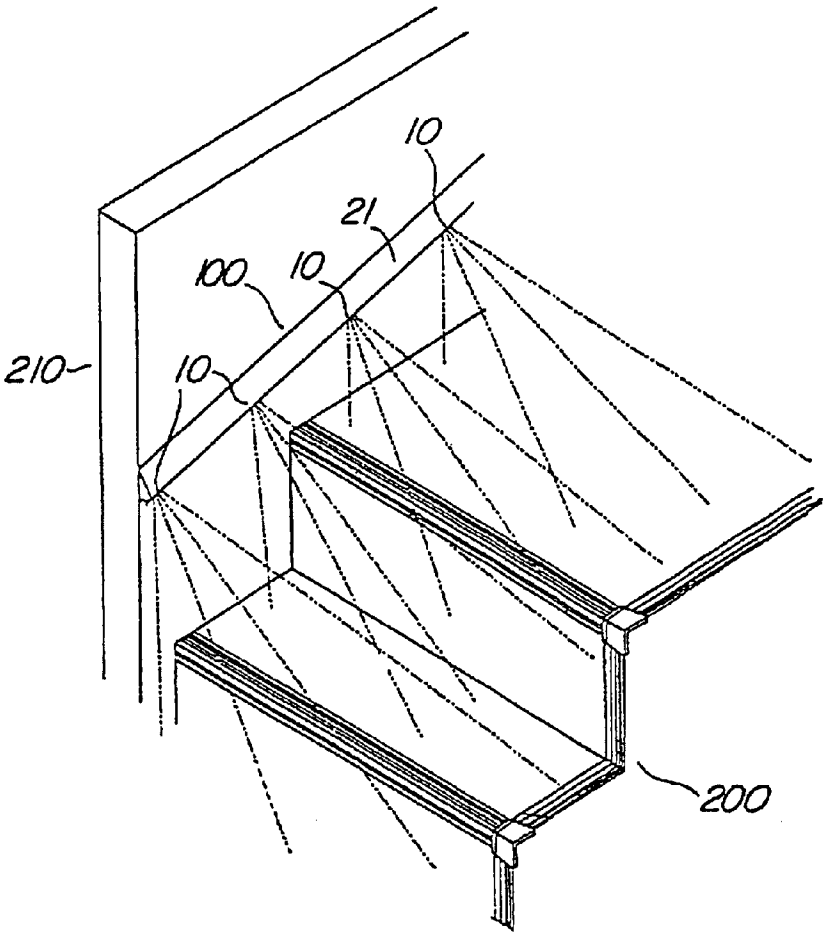
FIG. 6 is a view of a preferred embodiment of the invention in use casting light on stairs.

FIG. 6 depicts a preferred installation of the invention for illumination of steps 200. In FIG. 6, the fixture 100 is mounted to a surface 210 near steps 200. The light sources 10 illuminate the steps 200. The shield 21 of the lens component 20 shields light from the light sources 10 such that the majority of the illumination from the light sources is cast downward onto the steps 200 rather than up and/or out from the fixture 100 away from the target area for illumination. Preferably, when the fixture 100 is mounted at least 18 inches above the target area to be illuminated, the light from the light sources 10 can cast light up to 48 inches from the mounted fixture 100. This is approximately a seventy degree (70°) angle of illumination.

Figure 2:
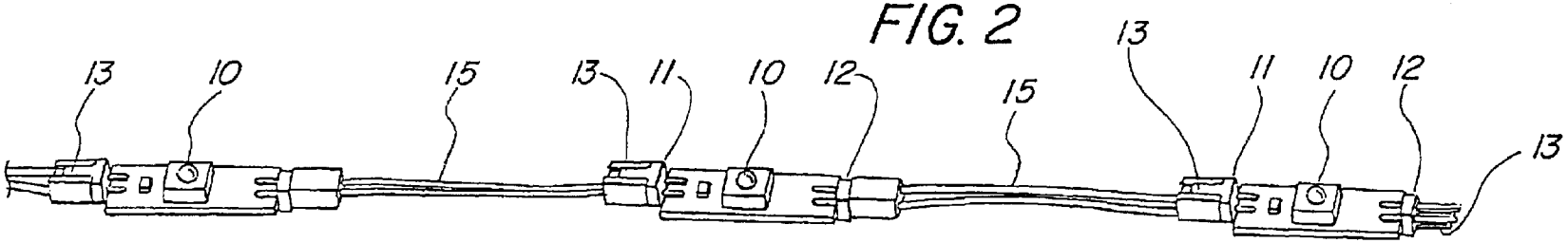
FIG. 2 is a perspective view of a preferred embodiment strand of LEDs and wire assemblies.

FIG. 2 shows a perspective view of a preferred embodiment strand of light sources 10, (LEDs and circuit boards shown), that are mounted within the lens component 20. Each light source is preferably a high brightness LED of material AlGalnP with super yellow emitted color and a lens color of water clear. The preferred LED model is an Alpinetech LP7615UYC LED.

Figure 4:
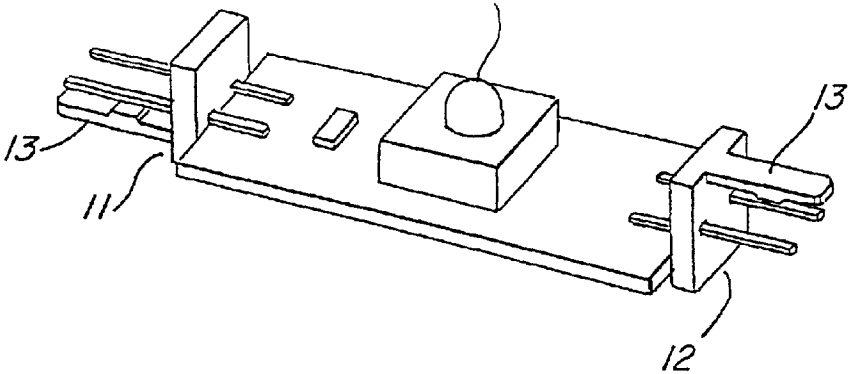
FIG. 4 is a perspective close-up view of an LED and board with the preferred embodiment of connectors.
Figure 3:
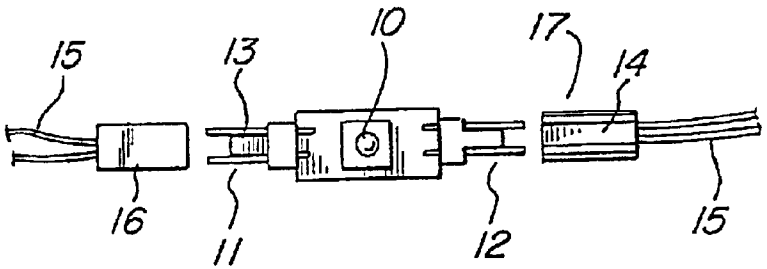
FIG. 3 is a close-up top view of the preferred embodiment of the connectors.
Figure 5:
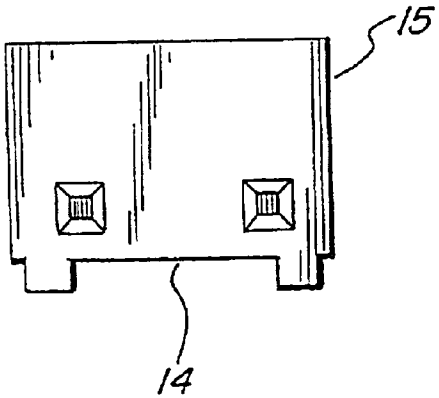
FIG. 5 is an end view of a preferred embodiment of the wire assembly.

Each light source 10 preferably mates to a wire assembly 15 via a connector with polarity-determined geometry. For example, the preferred embodiment described herein uses tongue 13 and groove 14 components. FIGS. 3, 4 and 5 show varying views of a preferred embodiment of these components. The wire assembly preferably comprises wires that are #20 GA AWG FTI 90 degrees C., 300 volts, UL recognized. The wire assemblies are preferably made in pre-determined lengths such as 3, 4 and 6 inches.

As described below, the polarity-determined geometry of the connectors 11 and 12 help insure that the light source 10 is connected to the strand of lights with the proper polarity. In addition to the tongue and groove arrangement described herein, the connectors 11, 12 and wire assemblies 15 can be mated with varying shaped connectors that only connect when the light source 10 is aligned to the proper polarity in the strand, e.g. a negative end of one light source 10 connects via a wire assembly 15 to the positive end of another light source 10. For example, the first connector 11 could be a round shape and the second connector 12 could be square with corresponding wire assembly 15 having ends to receive said connectors 11, 12 based on their polarity.

As depicted in the FIGS. 1–6, each light source 10 preferably comprises a first connector 11 on one end and a second connector 12 on the other end of the light source 10. Each connector 11, 12 has a tongue component 13. Each wire assembly 15 has a first end 16 and a second end 17. Each end 16, 17 of the wire assembly 15 has a groove component 14. Each tongue component 13 on the light source 10 mates or slides into an opposing groove component 14 on the wire assembly 15.

Thus, light sources 10 are more easily removed and replaced when damaged and/or inoperative. This reduces the possibility of needing the cumbersome process of replacing an entire light fixture or entire strand of light sources as is often necessary in prior art light fixtures due to, inter alia, soldered connections.

The polarity-determined geometry, as shown here the tongue 13 and groove 14 configuration, provides an advantage regarding the polarity of each light source 10. Each light source 10 typically requires that the wire assembly 15 be connected properly vis-a-vis the polarity of the connection. For example, the positive and negative terminals of each light source 10 should be connected via wire assembly 15 to the proper positive and negative terminals of light sources 10 adjoining in a strand of light sources 10 such as in FIG. 2. If the polarity of a light source 10 is not properly matched in a strand of light sources, a light source 10 and/or the entire strand can often be rendered, at least temporarily, inoperative.

FIG. 3 shows a close up view of a preferred light source, an LED 10, and the first connector 11 and second connector 12 at opposing ends. A light source 10 preferably has ends with opposing polarity, i.e. positive and negative polarity. Looking to FIG. 4, the tongue component 13 of each connector 11, 12 is placed in a predetermined position (the top and bottom of the connectors 12, 11 shown) such that the groove component 14 of the wire assembly 15 must be directed to a similarly situated tongue component 13. Thus, the groove components 14 on each end of the wire assembly 15 are also placed in pre-determined positions (again, top and bottom position shown in FIGS. 2 and 3.) Thus, the polarity of the strand of lights sources can be properly maintained by matching similarly situated tongue components 13 to groove components 14. If a wire assembly 15 or light source 10 is twisted or turned so that the proper polarity would not be maintained in the strand then the tongue 13 and groove 14 components will not match and a connection of faulty polarity is unlikely to be made.

This improvement assists with both the manufacture of strands and replacement of light sources 10. This improvement avoids the common problem in which the wires were soldered to the light sources with the wrong polarity during manufacture of the strands. This often caused the fixtures to be nonfunctional.

For replacement purposes, in a situation where the improved light fixture 100 contains a malfunctioning light source 10, this invention is useful for easier and safer replacement of light sources. The lens component 20 can be disconnected from the base component 30. The malfunctioning light source 10 is unmated from the adjacent wire assemblies 15 and a new functioning light source 10 can be placed in the strand. The tongue 13 and groove 14 components will only fit together if the polarity is correct, thus the chance of faulty replacement due to improper polarity is reduced. As such, the new light source 10 can be replaced more easily, quickly and properly without the need for soldering or replacement of entire strands of lights.

In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A light fixture comprising:

a lens component connected to a base component; wherein a plurality of light sources are mounted to and contained within the lens component;

the plurality of light sources are strung together by a plurality of wire assemblies;

each light source having a first end with a first polarity and a first connector, a second end with a second polarity and a second connector; the first connector having a polarity-dependent geometry corresponding to the first polarity and the second connector having a polarity dependent geometry corresponding to the second polarity; and, each wire assembly having a first end connectable to the polarity-dependent geometry of the first connector of one of the light sources and a second end connectable to the polarity-dependent geometry of the second connector of another light source.

2. The light fixture of claim 1 where the polarity-dependent geometry of the first connector is a tongue component and the first end of the wire assembly has a groove component that can be mated to the tongue component.

3. The light fixture of claim 1 wherein said lens component comprises a lens position perpendicular to the base component when connected to the base component.

4. The light fixture of claim 3 wherein said lens component further comprises a shield for preventing light from emitting from the light fixture except through the lens.

5. The light fixture of claim 1 where the polarity-dependent geometry of the first connector is a shaped prong and the first end of the wire assembly has a slot for receipt of the shaped prong.

6. A light source comprising:

a light emitting diode mounted on a circuit board having a first end and a second end of opposing polarity;

the first end having a first connector comprising a first polarity-determined geometry and a pair of leads; and, the second end having a second connector comprising a second polarity-determined geometry and a pair of leads.

7. The light source of claim 6 where the first polarity-determined geometry is a tongue element positioned above the pair of leads.

8. The light source of claim 6 where the second polarity-determined geometry is a tongue element positioned below the pair of leads.

9. The light source of claim 6 where the first polarity-determined geometry is mated to a polarity-determined connector of a wire assembly.

10. The light source of claim 6 where the second polarity-determined geometry is mated to a polarity-determined connector of a wire assembly.

* * * * *